US005918577A

United States Patent [19]

Martelli et al.

[11] Patent Number: 5,918,577

[45] Date of Patent: Jul. 6, 1999

[54] STRATIFIED EXHAUST RESIDUAL ENGINE

[75] Inventors: Ronald Lee Martelli, Ann Arbor; Christopher Warren, Farmington Hills; William Francis Stockhausen, Northville, all of Mich.

[73] Assignee: Ford Global Technologies, Inc., Dearborn, Mich.

[21] Appl. No.: 09/018,364

[22] Filed: Feb. 4, 1998

[51] Int. Cl.[6] ..... F02B 17/00

[52] U.S. Cl. ..... 123/295; 123/568.14; 123/90.15

[58] Field of Search ..... 123/295, 305, 123/568.14, 90.15

[56] References Cited

U.S. PATENT DOCUMENTS

| | | | |
|---|---|---|---|
| 3,625,189 | 12/1971 | Myers et al. | 123/568.14 |
| 4,193,382 | 3/1980 | Oshima . | |
| 4,282,845 | 8/1981 | Nohira et al. . | |
| 4,393,853 | 7/1983 | Groves . | |
| 4,426,986 | 1/1984 | Muller et al. | 123/568.14 |
| 4,821,686 | 4/1989 | Baika et al. . | |
| 4,856,473 | 8/1989 | Kawai et al. . | |
| 4,905,646 | 3/1990 | Tanahashi . | |
| 5,322,043 | 6/1994 | Shriner et al. | 123/295 |
| 5,379,743 | 1/1995 | Stokes et al. . | |
| 5,642,703 | 7/1997 | Stockahusen et al. . | |

OTHER PUBLICATIONS

SAE Technical Paper Series 950975—"Dual Equal VCT—A Variable Camshaft Timing Strategy for Improved Fuel Exonomy and Emissions" R. A. Stein, K. M. Galietti and T. G. Leone/Ford Motor Company Mar. 1995.

*Primary Examiner*—Erick R. Solis
*Attorney, Agent, or Firm*—Neil P. Ferraro

[57] ABSTRACT

A variable valve controlled engine causes the inducted exhaust residual to flow from the exhaust port(s) into specific regions of the combustion chamber and remain substantially separate from the air-fuel mixture, thereby creating stratification. The exhaust gas remains substantially on the piston surface and along the entire cylinder wall for at least a portion of the cylinder, with the air-fuel mixture occupying the remaining portion of the chamber.

14 Claims, 2 Drawing Sheets

STRATIFIED EXHAUST RESIDUAL ENGINE

FIELD OF THE INVENTION

This invention relates to variable valve controlled exhaust residual engines, and, more particularly to, variable valve controlled exhaust residual engines for creating stratified exhaust residual and air-fuel mixtures within combustion chambers.

BACKGROUND OF INVENTION

Current engine technologies employ throttling mechanisms to control the amount of air inducted into an engine. These throttling mechanisms have inherent losses associated with them. Significant improvements in engine fuel efficiency can be obtained by reducing these engine throttling losses. Lean-burn engine designs, for example, take advantage of reduced throttling; however, nitrogen oxide(s) (NOx) emission control is a major issue associated with lean-burn engine technology. Lean-burn engines may also exhibit relatively high hydro-carbon (HC) emissions due to undesirable formation of unburnable lean air-fuel mixtures within the engine's combustion chamber.

Exhaust gas recirculation (EGR) is commonly used in current engines. Engines which implement EGR generally redirect exhaust gas through the engine's intake manifold to mix with an incoming fresh air charge. EGR provides some reduction in throttling losses and significant reductive impact on engine NOx emissions for part-load engine operation. Furthermore, EGR can be used with stoichiometric air-fuel mixtures to allow the use of conventional three-way catalysts for effective exhaust emission control.

The inventors of the present invention have found certain disadvantages with these prior art EGR systems. For example, EGR and the air-fuel mixture comprise a homogenous mixture. Excessive amounts of EGR result in poor combustion, poor vehicle driveability, and low fuel efficiency. Therefore, the fuel efficiency benefit is limited by the amount of EGR that the engine can tolerate. In addition, prior art EGR systems do not effectively reduce HC emissions because the crevice region (region between the piston and cylinder) is not effectively isolated from the air-fuel mixture. Further many current engines with prior art EGR systems have intake ports designed to enhance mixture motion to improve EGR tolerance. But these designs result in a compromise at wide open throttle conditions where nearly 100% air-fuel mixture (substantially no EGR) is required to enter the combustion chamber in a relatively unrestricted manner. In addition, some lean-burn engines operate in a stratified mode. Stratification is typically enhanced by uniquely shaped intake ports or secondary intake port throttling to cause a desired type of mixture motion. At wide open throttle, these uniquely shaped intake ports or secondary port throttles may undesirably restrict the air flow, resulting in reduced high speed volumetric efficiency. That is, at wide open throttle, mixture motion is not necessarily desired. Thus, intake ports, which induce less mixture motion, are desirable. This may be accomplished in the present invention because, at low engine speeds or loads, part of the mixture motion in the chamber is induced through the exhaust port. Thus a less restrictive intake port design may be utilized.

SUMMARY OF THE INVENTION

An object of the present invention is to provide increased tolerance to high levels of EGR at low and medium engine loads while providing maximum power output at high engine loads. This object is achieved, and disadvantages of prior art approaches are overcome, by providing a novel four-stroke cycle, multi-cylinder reciprocating internal combustion engine with variable valve timing for producing a stratified EGR/air-fuel mixture within the combustion chamber. The engine has a plurality of cylinders, a crankshaft and a plurality of pistons reciprocally contained within the cylinders, and a plurality of combustion chambers each defined by a piston and a cylinder. In one particular aspect of the invention, the engine comprises an intake port having an intake valve in fluid communication with the combustion chamber, and an exhaust port having an exhaust valve in fluid communication with said combustion chamber. The exhaust port includes a means for directing exhaust gas into specific regions of the combustion chamber. The engine also includes a fuel injector for injecting fuel, either directly or indirectly, into the combustion chamber. A camshaft actuates the intake and exhaust valves and a camshaft phaser is attached to the camshaft for adjusting the timing of the camshaft with respect to the rotational position of the crankshaft. The engine further includes a sensor for sensing an operating condition of the engine and a controller, responsive to the sensor and connected to the camshaft phaser, for controlling the phaser for relative displacement between the intake and exhaust valves. Exhaust residual may then be inducted into the combustion chamber. The means for directing the exhaust gas causes the inducted exhaust residual to flow into specific regions of the combustion chamber and remain substantially separate from the air-fuel mixture, thereby creating the stratification. The exhaust gas remains substantially on the piston surface and along the entire cylinder wall for at least a portion of the cylinder to form an angularly truncated cup-shaped region, with the air-fuel mixture occupying the remaining portion of the chamber.

In a preferred embodiment, the exhaust gas remains substantially on the piston surface and along the entire cylinder wall for the entire cylinder to form a substantially cup-shaped region, with the air-fuel mixture occupying the remaining portion of the chamber.

An advantage of the present invention is that increased levels of EGR are tolerated.

Another, more specific, advantage of the present invention is that pumping losses are reduced resulting in greater fuel economy.

Another, more specific, advantage of the present invention is that hydrocarbon emissions of an engine are significantly reduced.

Another advantage of the present invention is that high-load combustion harshness is significantly reduced.

Yet another advantage of the present invention is that the propensity for engine knock is reduced.

Another advantage of the present invention is that heat transfer through the cylinder walls and piston is reduced, thereby increasing the thermodynamic efficiency of the engine.

Still another advantage of the present invention is that the intake charge motion needed for part-load operation is significantly reduced.

Another advantage is that the amount of mixture motion from the exhaust residuals favorably increases proportional to the amount of exhaust residuals drawn into the chamber.

Another, more specific, advantage of the present invention is that increased volumetric efficiency is provided during high load operation.

Yet another advantage is that combustion burn rate control is provided by varying the amount of exhaust residual charge motion utilizing variable exhaust valve timing.

Other objections, features and advantages of the present invention will be readily appreciated by the reader of this specification.

BRIEF DESCRIPTION OF THE DRAWINGS

The invention will now be described, by way of example, with reference to the accompanying drawings in which.

DETAILED DESCRIPTIONS OF THE PREFERRED EMBODIMENTS

Figure 1:
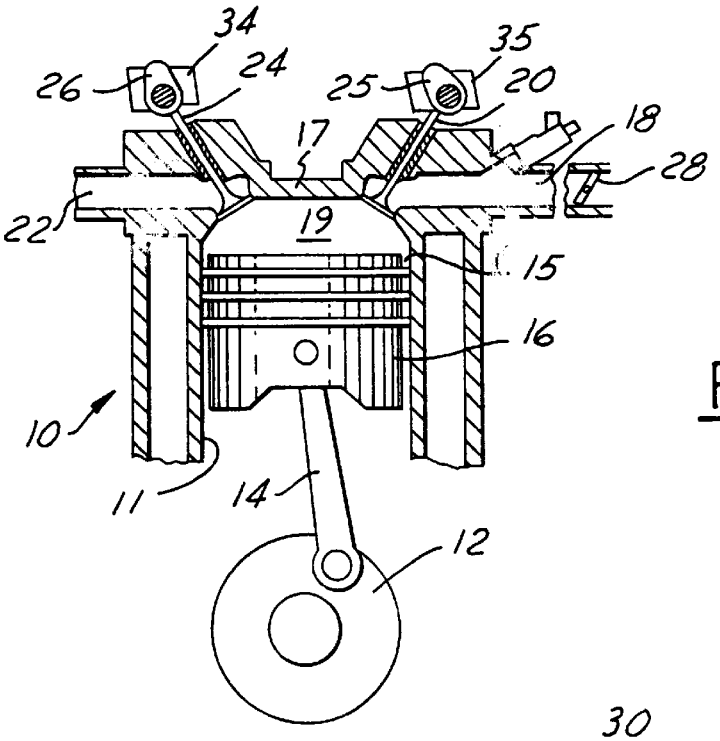
FIG. 1 is a schematic representation of a variable valve controlled engine according to the present invention.

As shown in FIG. 1, one cylinder of a multi-cylinder four-stroke cycle reciprocating internal combustion engine 10 has cylinder 11, crankshaft 12 with connecting rod 14 and piston 16 disposed within cylinder 11. Crevice region 15 is defined by the area between cylinder 11 and piston 16. Cylinder head 17 closes an end of cylinder 11 and cooperates with piston 16 to define combustion chamber 19. Combustion chamber 19 communicates with intake port 18 and exhaust port 22 by intake valve 20 and exhaust valve 24, respectively. Intake valve 20 is operated by intake camshaft 25 and exhaust valve 24 is operated by exhaust camshaft 26. According to the present invention, exhaust camshaft phaser 34 is coupled to camshaft 26.

Figure 2:
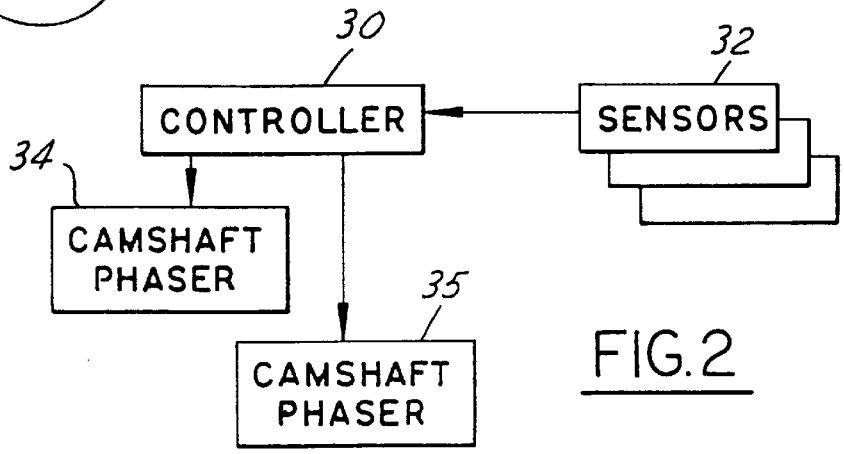
FIG. 2 is a block diagram of a control system according to the present invention.

FIG. 2 illustrates a control system according to the present invention. Controller 30 receives a variety of inputs from engine operating sensors 32, which include many of the types of sensors known to those skilled in the art of engine control and suggested by this disclosure. Accordingly, sensors 32 may include engine speed, engine load, intake manifold absolute pressure, engine intake air mass flow rate, engine exhaust mass flow rate, engine temperature, vehicle speed, vehicle gear selection, accelerator position, and other parameters known to those skilled in the art and suggested by this disclosure. Controller 30, which may comprise an electronic engine operating controller drawn from many types known to those skilled in the art of automotive electronic engine controllers, is connected with camshaft phaser 34. One camshaft phaser is required when using a single overhead cam to actuate both intake valve 20 and exhaust valve 24. However, in the case of a dual overhead cam, a second camshaft phaser 35 may be used. Alternatively, both camshafts may be linked together with one phaser. Furthermore, those skilled in the art will recognize that solenoid actuators could supplant the phaser and camshaft system described above.

Camshaft phasers are used to change the camshaft timing relative to crankshaft position to induct exhaust gas from the exhaust port during the intake stroke of the engine. Controller 30, compares sensed operating parameters with predetermined threshold values. For example, in a typical control algorithm, exhaust residual induction into combustion chamber 19 would not be used until the engine load exceeds a minimum threshold value. In this sense, the term "exceed" is used herein to mean that the value of the sensed parameter may either be greater than or less than the threshold value. In the event that sensed parameters exceed threshold values, controller 30 will command camshaft phaser 34 or 35 or both to move to adjust or shift the timing of camshafts 25 or 26 or both that operate intake valve 20 and exhaust valve 24, respectively. In particular, when the timing of exhaust camshaft 26 is changed, varied levels of exhaust gas residual may flow from exhaust port 22 into predetermined regions of combustion chamber 19. The fact remains that there are many conditions in which it is desirable to operate an engine with varying amounts of induced exhaust residuals, which, in turn, create stratified charges within combustion chamber 19. Hereinafter, directed exhaust gases into the combustion chamber will be termed exhaust residuals.

Figure 3:
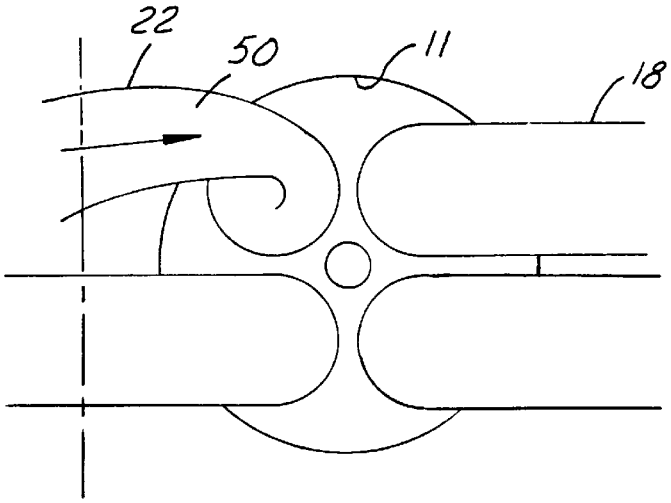
FIGS. 3 and 4 are schematic representations of means for controlling exhaust flow into the combustion chamber according to the present invention; and, FIGS. 5–8 are schematic illustrations of the charge within the combustion chamber of the engine according to the present invention.
Figure 4:
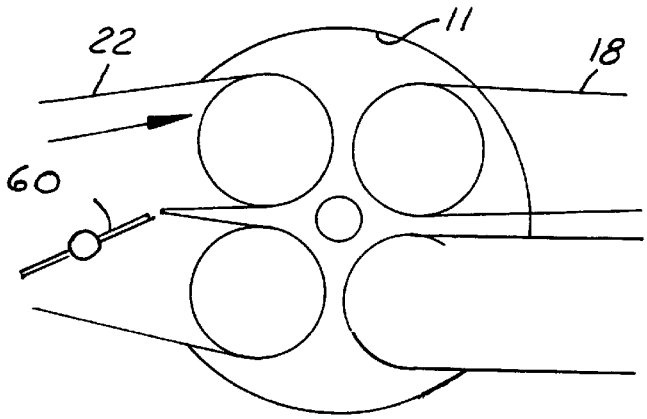

According to the present invention, exhaust port 22 may contain a specific structure or device that works in conjunction with variable valve control to direct exhaust residuals into specific regions of combustion chamber 19. Accordingly, as will be apparent to those skilled in the art, a helical exhaust port 50, as shown in FIG. 3, or a motion control valve 60, as shown in FIG. 4, may be used in conjunction with variable valve control as a means to direct the exhaust residual into specific regions of combustion chamber 19. Alternatively, a directed exhaust port, including tandem ports and twisted ports to name a few, (not shown) may be used. While four vales/cylinder are shown in the example described herein, those skilled in the art will recognize in view of this disclosure that any number of valves/cylinder may be used, provided that the port structure or arrangement or a port device, such as a motion control valve is used to obtain the desired exhaust gas motion within chamber 19.

Figure 5:
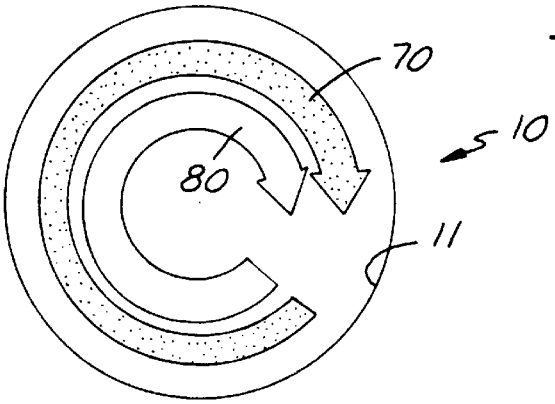
Figure 6:
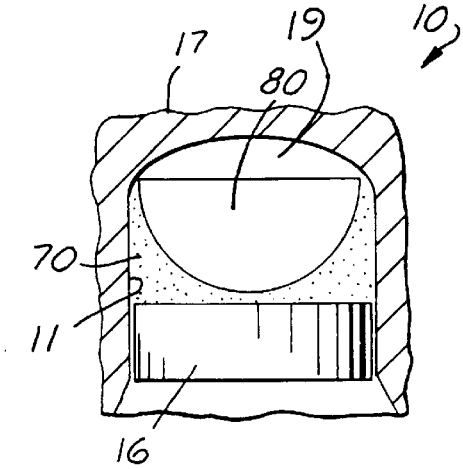

Turning now to FIGS. 5 and 6, once controller 30 determines that the sensed parameters have exceeded threshold values, controller 30 will command camshaft phasers 34 or 36 or both to move to adjust or shift the timing of camshafts 25 and 26 which operate intake valve 20 and exhaust valve 24, respectively, to induce varied levels of exhaust gas residual remaining in exhaust port 22 after the exhaust stroke of engine 10. Induction of varying amounts of exhaust residual will occur during the early portion of the intake stroke of engine 10 through exhaust port 22, which may be helical port 50, directed port (not shown) or past motion control valve 60, if helical port 50 or directed port (not shown) are not used, past exhaust valve 24 and into the outermost regions of combustion chamber 19. Subsequently, air is inducted through intake port 18, past intake valve 20 into combustion chamber 19 while fuel is injected into said airstream to produce a radially stratified exhaust and air-fuel mixture within combustion chamber 19. Referring in particular to FIGS. 5 and 6, a radially stratified mixture is shown, where the exhaust residual 70 rotates about an axis primarily parallel to the axis of the cylinder and resides along the entire wall of the entire cylinder and along the top of piston 16 to form a substantially cup-shaped exhaust region, while the air-fuel mixture 80 rotates about an axis primarily parallel to the axis of the cylinder and resides substantially in the center of combustion chamber 19. In this example, the air-fuel mixture swirls in a tighter motion relative to the exhaust residual, although the volume may be larger. The exact amount of exhaust residual to be induced into the combustion chamber is dependent upon a variety of engine operation conditions and may be readily determined by those skilled in the art. For example, the amount of residual would primarily be determined by varying the exhaust cam timing, where the VVT control system would primarily take into account the engine speed, load and intake manifold pressure. It should be noted that, the present invention is operative for both a port injected engine, as shown, or a direct injected engine, where the fuel injector injects fuel directly into the combustion chamber.

Figure 7:
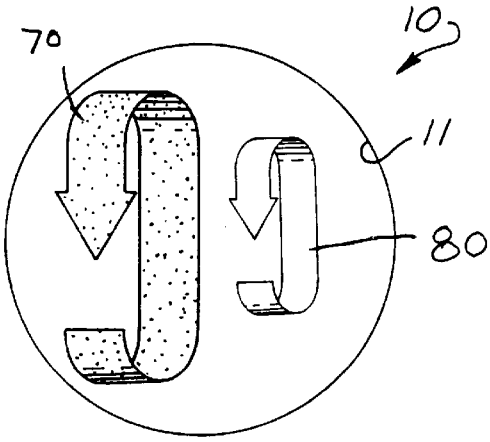
Figure 8:
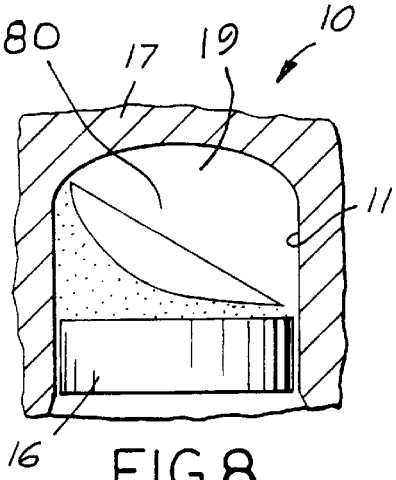

In an alternative embodiment according to the present invention, as shown in FIGS. 7. and 8, a vertically stratified mixture is shown, where the exhaust residual 70 rotates about an axis primarily perpendicular to the axis of the cylinder and resides along the entire wall of the cylinder for at least a portion of the cylinder and along the top of piston 16 to form an angularly truncated cup-shaped region, while the air-fuel mixture 80 rotates about an axis primarily perpendicular to the axis of the cylinder and occupies the remaining space in combustion chamber 19. In this example, the air-fuel mixture tumbles in a tighter motion relative to the exhaust residual, although the volume may be larger. The exact amount of exhaust residual to be induced into the combustion chamber is dependent upon a variety of engine operation conditions and may be readily determined by those skilled in the art.

In both embodiments, HC emissions are reduced in two manners. First, the crevice region above the piston ring(s) is effectively isolated from the air-fuel mixture by the exhaust residuals. Second, the exhaust residuals exiting the chamber at the end of the exhaust stroke have the highest HC emissions, and these are the first residuals to be drawn back into the chamber to be combusted in the next engine cycle.

In both embodiments, the exhaust residual resides substantially along the walls of the cylinder and along the piston surface, decreasing heat transfer from the combustion chamber, thereby reducing fuel consumption of the engine. Both embodiments also utilize a less restrictive intake port design, resulting in less motion induced by the intake port.

While the best mode for carrying out the invention has been described in detail, those skilled in the art in which this invention relates will recognize various alternative designs and embodiments, including those mentioned above, in practicing the invention that has been defined by the following claims. For example, both a radially and vertically stratified mixture may be obtained in a single combustion chamber using a combination of arrangements to produce both swirl and tumble motion.

We claim:

1. A four-stroke cycle, multi-cylinder reciprocating internal combustion engine with variable valve timing for producing a stratified EGR/air-fuel mixture, the engine having a plurality of cylinders, a crankshaft and a plurality of pistons reciprocally contained within the cylinders, and a plurality of combustion chambers each defined by the piston and a cylinder, said engine comprising:

an intake port in fluid communication with said combustion chamber, with said intake port including an intake valve;

an exhaust port in fluid communication with said combustion chamber, with said exhaust port including an exhaust valve and a means for directing exhaust gas into specific regions of said combustion chamber;

a fuel injecting means for injecting fuel within into the combustion chamber;

a camshaft for operating said intake valve and said exhaust valve;

a camshaft phaser attached to said camshaft for adjusting the timing of the camshaft with respect to the rotational position of the crankshaft;

a sensor for sensing at least one engine operating condition; and, a controller, responsive to said sensor and connected to said camshaft phaser, for controlling a relative displacement between said intake and exhaust valves by operating said camshaft phaser such that an exhaust residual is inducted into said combustion chamber, with said means for directing exhaust gas into specific regions of said combustion chamber causing said inducted exhaust residual to flow into specific regions of said combustion chamber and air is subsequently inducted into said combustion chamber through said intake port while fuel is injected into said airstream to produce a stratified exhaust and air-fuel mixture, wherein said exhaust gas remains substantially on the piston surface and along the entire cylinder wall for at least a portion of the cylinder, with the air-fuel mixture occupying the remaining portion of the chamber.

2. An engine according to claim 1 wherein said exhaust gas remains substantially on the piston surface and along the entire cylinder wall for the entire cylinder, with the air-fuel mixture occupying the remaining portion of the chamber.

3. An engine according to claim 1 further comprising a crevice defined by the area between the piston and cylinder, with said crevice region being substantially isolated from said air-fuel mixture by said exhaust gas.

4. An engine according to claim 1, wherein said stratified mixture comprises a substantially radially stratified mixture.

5. An engine according to claim 2, wherein said stratified mixture comprises a radially and vertically stratified mixture.

6. An engine according to claim 1 wherein said means for directing exhaust gas into specific regions of said combustion chamber comprises a helically shaped exhaust port.

7. An engine according to claim 1 wherein said means for directing exhaust gas into specific regions of said combustion chamber comprises a motion control valve disposed within said exhaust port.

8. An engine according to claim 1 wherein said exhaust gas occupies a region defined by an angularly truncated cup-shaped region.

9. An engine according to claim 2 wherein said exhaust gas occupies a region defined by a cup-shaped region.

10. A method of inducting exhaust residual gas and intake air-fuel mixtures to produce a stratified exhaust and air-fuel mixtures in a combustion chamber of an engine employing variable valve timing, the engine having a cylinder, a crankshaft rotatably disposed within the engine, a piston rotatably connected to the crankshaft and moveable within the cylinder, a combustion chamber defined by the piston and cylinder, an intake port and an exhaust port each in fluid communication with the combustion chamber, and a crevice region defined by an area between the piston and cylinder, with said method comprising the steps of:

inducting air through the intake port into the combustion chamber;

injecting fuel into the air to produce an air-fuel mixture; and, inducting an exhaust residual through said exhaust port into predetermined regions of said combustion chamber to produce a stratified exhaust and air-fuel mixture, with said exhaust residual remaining substantially on the piston surface and along the entire cylinder wall for at least a portion of the cylinder, with the air-fuel mixture occupying the remaining portion of the chamber.

11. A method according to claim 10 wherein said inducting an exhaust residual step comprises the step of directing the exhaust gas such that said exhaust gas remains substantially on the piston surface and along the entire cylinder wall for the entire cylinder, with the air-fuel mixture occupying the remaining portion of the chamber.

12. A method according to claim 10 further comprising the step of isolating the crevice region from the air-fuel mixture with the exhaust residual.

13. A method according to claim 10, wherein said stratified mixture comprises a substantially radially stratified mixture.

14. A method according to claim 11, wherein said stratified mixture comprises a radially and vertically stratified mixture.

* * * * *